US011821243B2

(12) United States Patent
Lim et al.

(10) Patent No.: US 11,821,243 B2
(45) Date of Patent: Nov. 21, 2023

(54) FRUNK LATCH EMERGENCY OPENING STRUCTURE

(71) Applicants: HYUNDAI MOTOR COMPANY, Seoul (KR); KIA MOTORS CORPORATION, Seoul (KR); PYEONG HWA AUTOMOTIVE CO., LTD., Daegu (KR)

(72) Inventors: Sang Kyoon Lim, Bucheon-si (KR); Sang Il Kim, Hwaseong-si (KR); Ki Ryun Ahn, Daegu (KR); Hyeon Tae Park, Daegu (KR)

(73) Assignees: HYUNDAI MOTOR COMPANY, Seoul (KR); KIA MOTORS CORPORATION, Seoul (KR); PYEONG HWA AUTOMOTIVE CO., LTD., Daegu (KR)

( * ) Notice: Subject to any disclaimer, the term of this patent is extended or adjusted under 35 U.S.C. 154(b) by 373 days.

(21) Appl. No.: 17/092,928

(22) Filed: Nov. 9, 2020

(65) Prior Publication Data

US 2021/0172206 A1 Jun. 10, 2021

(30) Foreign Application Priority Data

Dec. 9, 2019 (KR) ..... 10-2019-0162324

(51) Int. Cl.
*E05B 83/26* (2014.01)
*E05B 77/00* (2014.01)
(Continued)

(52) U.S. Cl.
CPC ..... *E05B 83/26* (2013.01); *E05B 77/00* (2013.01); *E05B 79/22* (2013.01); *E05B 83/243* (2013.01); *E05B 85/243* (2013.01)

(58) Field of Classification Search
CPC ..... E05B 83/16; E05B 83/18; E05B 83/24; E05B 83/243; E05B 83/26; E05B 79/20;
(Continued)

(56) References Cited

U.S. PATENT DOCUMENTS 8,798,858 B2 * 8/2014 Zysk ..... E05B 81/56 307/326
8,833,811 B2 * 9/2014 Ishikawa ..... E05B 17/106 292/336.3

(Continued)

FOREIGN PATENT DOCUMENTS

KR 101560979 B1 10/2015

*Primary Examiner* — Kristina R Fulton
*Assistant Examiner* — Noah Horowitz
(74) *Attorney, Agent, or Firm* — LEMPIA SUMMERFIELD KATZ LLC

(57) ABSTRACT

A frunk latch emergency opening structure includes: a base configured to be fixed to a vehicle body; a pawl provided on the base so as to be rotatable; a first cable connected to one end of the pawl and configured such that tension is applied to the first cable by operating a vehicle inside handle; an emergency lever configured to be rotatable in an interlocking manner with the pawl at one end of the emergency lever; a second cable connected to another end of the emergency lever and configured such that tension is applied to the second cable by operating a frunk inside handle; and a safety hook configured to be coupled to the base so as to be rotatable and to move due to operation of a front outside lever.

5 Claims, 7 Drawing Sheets

(51) Int. Cl.
*E05B 85/24* (2014.01)
*E05B 83/24* (2014.01)
*E05B 79/22* (2014.01)

(58) Field of Classification Search
CPC ..... E05B 79/22; E05B 85/24; E05B 85/243; E05B 85/26; Y10T 292/081; Y10T 292/0825; Y10T 292/083; Y10T 292/0831; Y10T 292/0948; Y10T 292/1047; Y10T 292/1048; Y10T 292/1057; Y10T 292/1059; Y10T 292/1078; Y10T 292/108; Y10S 292/14; Y10S 292/42; Y10S 292/43
See application file for complete search history.

(56) References Cited

U.S. PATENT DOCUMENTS

| | | | | |
|---|---|---|---|---|
| 9,163,435 | B2 * | 10/2015 | Zysk | E05B 83/26 |
| 10,273,726 | B2 | 4/2019 | Park | |
| 10,669,751 | B2 * | 6/2020 | Kim | E05B 81/72 |
| 10,808,436 | B2 * | 10/2020 | Cuddihy | E05B 83/24 |
| 10,822,846 | B2 * | 11/2020 | Perring | E05B 83/24 |
| 10,941,592 | B2 * | 3/2021 | Taurasi | E05B 77/08 |
| 10,941,593 | B2 * | 3/2021 | Krishnan | E05B 79/20 |
| 2020/0399936 | A1 * | 12/2020 | Bartola | E05B 83/24 |

* cited by examiner

FRUNK LATCH EMERGENCY OPENING STRUCTURE

CROSS-REFERENCE TO RELATED APPLICATION

This application claims under 35 U.S.C. § 119(a) the benefit of priority to Korean Patent Application No. 10-2019-0162324 filed on Dec. 9, 2019, the entire contents of which are incorporated herein by reference.

BACKGROUND

(a) Technical Field

The present disclosure relates to a frunk latch emergency opening structure. More particularly, it relates to a frunk latch emergency opening structure, which is configured not only to be basically operated but also to be opened from the inside of a frunk in case of emergency through one latch structure.

(b) Background Art

In general, an engine compartment is provided in the front portion of a vehicle, and the engine compartment is opened and closed by a frunk lid (i.e., hood). The frunk lid functions not only to open and close the engine compartment but also to shield the engine compartment so as to block engine noise. Left and right sides of the rear end of the frunk lid are coupled to the upper portion of the engine compartment by hinge assemblies. Thus, the frunk lid is rotated around the hinge assemblies to open and close the engine compartment.

Recently, instead of mounting a traditional powertrain, such as an engine, a transmission, and the like, in an engine compartment, demand for electric vehicles in which a battery is mounted on a floor of a vehicle body has gradually increased. Therefore, the space of the engine compartment in which the traditional powertrain is mounted is used as a trunk. This trunk is generally referred to as a frunk, i.e., an abbreviation of a front trunk, because it is located in the front portion of the vehicle.

In general, a vehicle hood has a structure, which is locked in two steps by a safety lever. Thus, a two-step safety device for opening the vehicle hood is prepared such that, in order to release the locked hood, locking of the hood is primarily released through a front surface cable operation by operating a release lever inside the vehicle. The hood is secondarily opened by releasing the safety lever by putting a user hand into an engine compartment.

This serves to satisfy automobile safety standard regulations. Herein, a firm latch device must be installed in a vehicle hood, and a vehicle, having a structure in which a vehicle hood is opened and closed in a forward direction. If the vehicle hood is opened during driving, the hood may obscure the driver's view. Thus, the firm latch device is regulated so as to have a structure in which secondary locking or locking at two places are possible.

Usually, an operation to open a front hood includes a primary opening operation in which locking of a hood latch is released and a secondary opening operation in which a user turns over a safety lever in an opening direction.

The safety lever prevents the hood from momentarily popping up during the primary opening operation of the hood. The hood is lifted up by the secondary opening operation in which the safety lever is turned over in the opening direction.

However, if respective latch structures for the primary opening operation and the secondary opening operation are applied, the total weight of the hood is heavy, installation costs of the hood are excessively high, and a broad space is required to install the latch structures. Further, installation of a separate electric latch increases installation costs and failure probability.

SUMMARY OF THE DISCLOSURE

The present disclosure has been made in an effort to solve the above-described problems associated with the prior art. It is an object of the present disclosure to provide a frunk latch emergency opening structure which is configured not only to be basically operated but also to be opened from the inside of a frunk in case of emergency through one latch structure.

It is another object of the present disclosure to provide a frunk latch emergency opening structure in which an electric method as a latch operation method may be replaced with a mechanical method.

In one aspect, the present disclosure provides a frunk latch emergency opening structure. The frunk latch emergency opening structure includes: a base configured to be fixed to a vehicle body; a pawl provided on the base so as to be rotatable; a first cable connected to one end of the pawl and configured such that tension is applied to the first cable by operating a vehicle inside handle; an emergency lever configured to be rotatable in an interlocking manner with the pawl at one end of the emergency lever; a second cable connected to another end of the emergency lever and configured such that tension is applied to the second cable by operating a frunk inside handle; and a safety hook configured to be coupled to the base so as to be rotatable and to move due to operation of a front outside lever.

In an embodiment, the frunk latch emergency opening structure may further include a catch configured to move in an interlocking manner with rotation of the pawl. The frunk latch emergency opening structure may also include a striker connected at one end to a frunk lid (i.e., hood) configured to cover a frunk and provided with another end configured to be detachably inserted into the catch so as to open and close the frunk lid according to rotation of the catch.

In another embodiment, a hook plate may be formed at one end of the safety hook. A hook protrusion configured to protrude through a rear surface of the base may be formed at another end of the safety hook.

In still another embodiment, the one end of the emergency lever may interlock with the pawl and the other end of the emergency lever may be rotated in an interlocking manner with the hook protrusion.

In yet another embodiment, the frunk latch emergency opening structure may further include an emergency lever stopper located so as to correspond to the other end of the emergency lever and configured to interfere with the emergency lever during movement of the emergency lever. The emergency lever may be configured to move along a side surface of the emergency lever stopper when tension is applied to the second cable.

In still yet another embodiment, when tension is applied to the first cable, the one end of the pawl may be rotated and the catch may be released from the striker, such that locking of the frunk may be released.

In a further embodiment, the safety hook may move due to operation of a frunk outside lever and may allow the frunk to pop up.

In another further embodiment, when tension is applied to the second cable, the other end of the emergency lever may be rotated, the pawl may be rotated corresponding to the one end of the emergency lever, and the catch may be released from the striker, such that locking of the frunk may be released.

In still another further embodiment, the other end of the emergency lever may move along a side surface of the emergency lever stopper. The hook protrusion may move in an interlocking manner with the other end of the emergency lever.

In yet another further embodiment, the emergency lever may be inserted into a space between the hook protrusion and the emergency lever stopper, such that the emergency lever maybe fixed.

Other aspects and embodiments of the disclosure are discussed below.

The above and other features of the disclosure are discussed below.

BRIEF DESCRIPTION OF THE DRAWINGS

The above and other features of the present disclosure are described in detail with reference to certain embodiments thereof illustrated in the accompanying drawings which are given hereinbelow by way of illustration only, and thus are not limitative of the present disclosure, and wherein.

It should be understood that the appended drawings are not necessarily to scale, presenting a somewhat simplified representation of various features illustrative of the basic principles of the disclosure. The specific design features of the present disclosure as disclosed herein, including, for example, specific dimensions, orientations, locations, and shapes, are determined in part by the particular intended application and use environment.

In the figures, reference numbers refer to the same or equivalent parts of the present disclosure throughout the several figures of the drawings.

DETAILED DESCRIPTION

Hereinafter, reference is made in detail to various embodiments of the present disclosure, examples of which are illustrated in the accompanying drawings and described below. While the disclosure is described in conjunction with various embodiments, it is understood that the present description is not intended to limit the disclosure to the various embodiments. On the contrary, the disclosure is intended to cover not only the disclosed embodiments, but also various alternatives, modifications, equivalents and other embodiments, which may be included within the spirit and scope of the disclosure as defined by the appended claims.

In the following description of the embodiments, terms, such as " . . . part" and the like mean units to process at least one function or operation, and they may be implemented by hardware or a combination of hardware.

In addition, in the following description of the embodiments, "frunks" conceptually include a front trunk and a rear trunk, and in the embodiments, one end of a frunk is subject to description.

Further, in the following description of the embodiments, "a rear surface" means a rear portion of a base 110 in the longitudinal direction of a vehicle based on the plan surface of the base 110. Likewise, "a front surface" means a front portion of the base 110 in the longitudinal direction of the vehicle based on the plan surface of the base 110.

Moreover, in the following description of the embodiments, "a basic mode" means a frunk open mode in general situations and "an emergency mode" means a mode in which a frunk can be opened by operating a frunk inside handle 400 in a situation in which a person is confined in the frunk.

When an element or component in the written description and/or claims is identified and described as having a purpose or performing or carrying out a stated function, step, set of instructions, or the like, the element or component may also be considered as being "configured to" do so.

Figure 1:
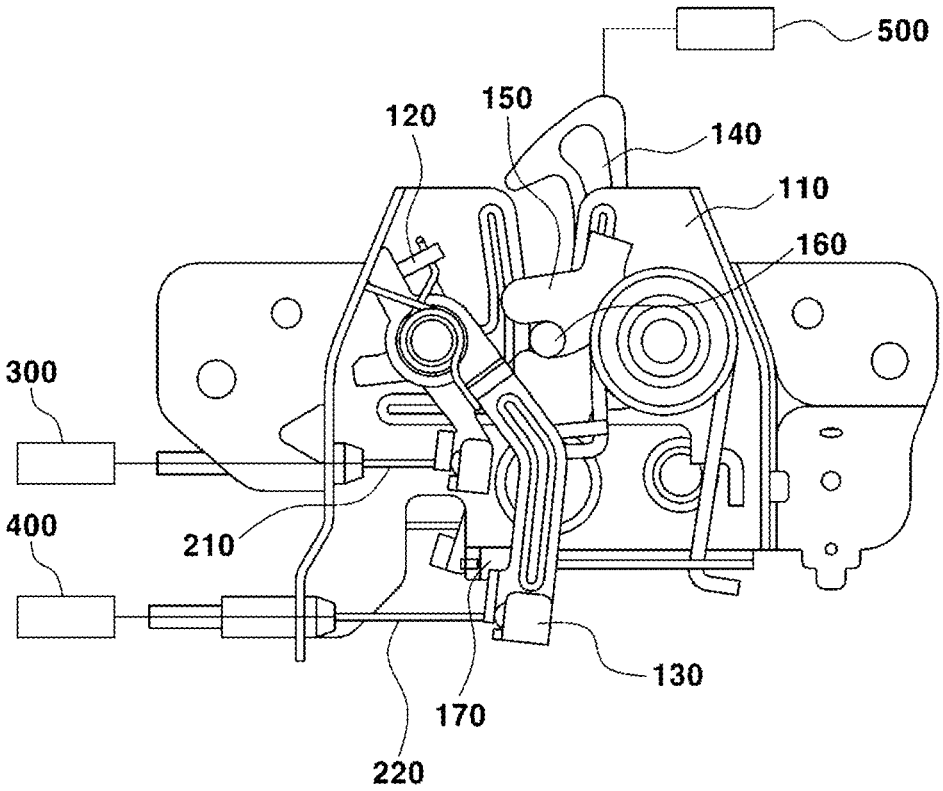
FIG. 1 is a rear view illustrating the configuration of a frunk latch emergency opening structure according to one embodiment of the present disclosure.
Figure 2:
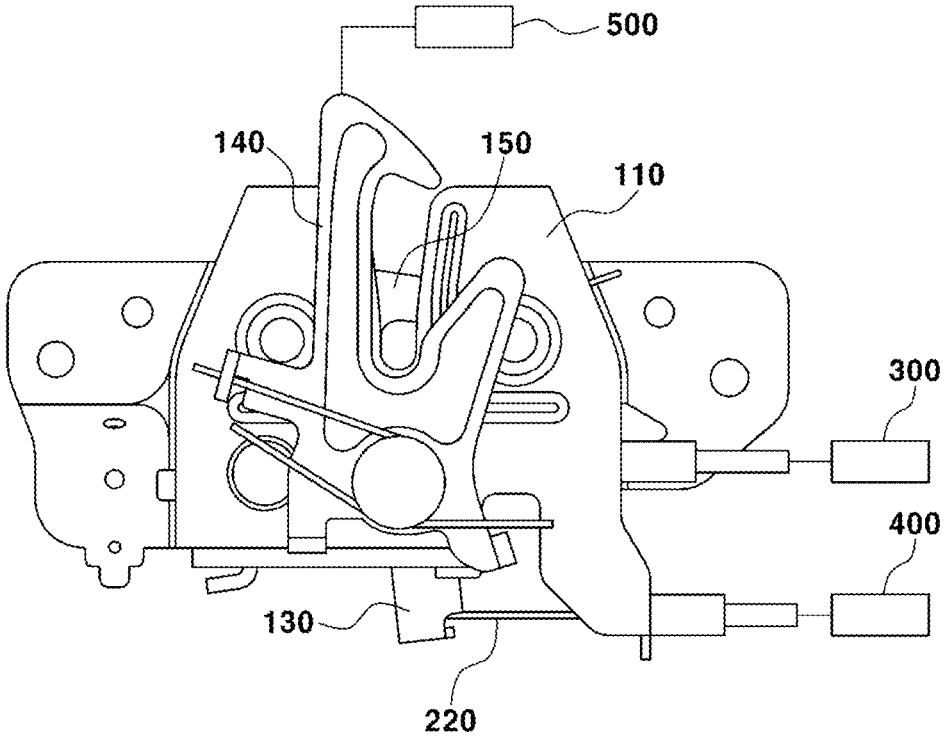
FIG. 2 is a front view illustrating the configuration of the frunk latch emergency opening structure according to one embodiment of the present disclosure.
Figure 3:
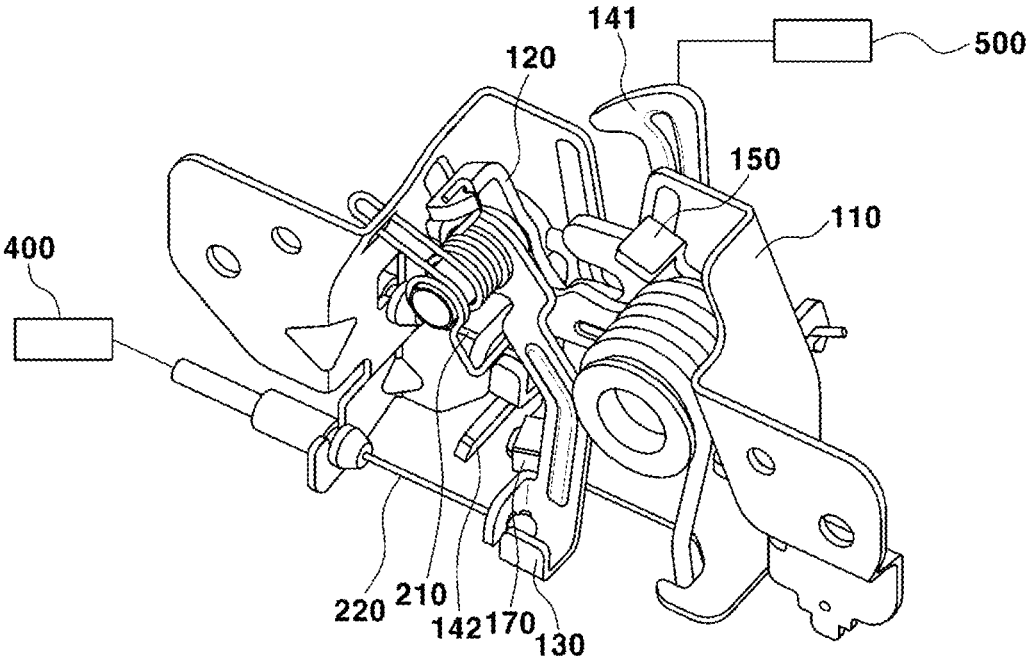
FIG. 3 is a perspective view illustrating the configuration of the frunk latch emergency opening structure according to one embodiment of the present disclosure.

FIG. 1 is a rear view illustrating the configuration of a frunk latch emergency opening structure according to one embodiment of the present disclosure. FIG. 2 is a front view illustrating the configuration of the frunk latch emergency opening structure according to one embodiment of the present disclosure. FIG. 3 is a perspective view illustrating the configuration of the frunk latch emergency opening structure according to one embodiment of the present disclosure.

The frunk latch emergency opening structure according to one embodiment of the present disclosure may include the base 110 fixed to a vehicle body, a pawl 120 provided on the base 110 so as to be rotatable, a first cable 210 connected to one end of the pawl 120 and configured such that tension is applied to the first cable 210 by operating a vehicle inside handle 300, an emergency lever 130 configured to be rotatable in an interlocking manner with the pawl 120 at one end of the emergency lever 130, a second cable 220 connected to the other end of the emergency lever 130 and configured such that tension is applied to the second cable 220 by operating the frunk inside handle 400, and a safety hook 140 configured to be coupled to the base 110 so as to be rotatable and to move due to operation of a front outside lever 500.

Further, the frunk latch emergency opening structure may further include a catch 150 configured to move in an interlocking manner with rotation of the pawl 120. The frunk latch emergency opening structure may also include a striker 160 connected at one end to a frunk lid configured to cover a frunk. The striker 160 may be provided with another end configured to be detachably inserted into the catch 150 so as to open and close the frunk lid according to rotation of the catch 150.

The base 110 may be configured to form a frame of the frunk latch emergency opening structure and be fixed to the front end of the vehicle body. The base 110 may be provided with parts, such as the pawl 120, the first cable 210, the emergency lever 130, the second cable 220 and the safety hook 140, on the rear and front surfaces thereof so as to fix these parts to the vehicle body and support the parts.

A guide groove may be formed by cutting the center of the upper end of the base 110 to a designated depth in the downward direction. The striker 160 adhered to the front end of the frunk may be inserted into the guide groove when the frunk is closed.

The pawl 120 may be provided on the rear surface of the base 110 so as to be rotatable. More particularly, the pawl 120 may be configured to be pin-coupled to the rear surface of the base 110 and thus be rotated when tension is applied to the first cable 210. The first cable 210 may be connected to the one end of the pawl 120. The other end of the pawl 120 may be located so as to interlock with one end of the emergency lever 130 and one end of the catch 150, as described below.

The first cable 210 may be configured to be connected to one end of the pawl 120 so that tension is applied to the first cable 210 by operating the vehicle inside handle 300. In the basic mode, when the vehicle inside handle 300 is pulled, the first cable 210 may be pulled and the one end of the pawl 120 may be rotated.

The emergency lever 130 may be provided on the rear surface of the base 110 so as to be rotatable. The emergency lever 130 may be configured such that one end of the emergency lever 130 interlocks with the pawl 120 and the other end of the emergency lever 130 interlocks with a hook protrusion 142, as described below, so as to be rotated. More particularly, the emergency lever 130 may be configured to be rotated coaxially with the pawl 120.

The frunk latch emergency opening structure according to one embodiment of the present disclosure may further include an emergency lever stopper 170 located so as to correspond to the other end of the emergency lever 130. The emergency lever stopper 170 may be configured to interfere with the emergency lever 130 during horizontal movement of the emergency lever 130. The emergency lever 130 may be configured to move along the side surface of the emergency lever stopper 170 when tension is applied to the second cable 220, as described below.

The emergency lever stopper 170 may be located at the lower portion of the rear surface of the base 110, close to the other end of the emergency lever 130. More particularly, the emergency lever stopper 170 may be fixedly installed such that the side surface of the emergency lever stopper 170 is tilted at a designated angle with respect to the rear surface of the base 110. In an initial state, the other end of the emergency lever 130 may interfere with the rear surface of the stopper 170. When the other end of the emergency lever 130 is rotated, the other end of the emergency lever 130 may move along the side surface of the emergency lever stopper 170. A projection may be formed on the front surface of the emergency lever stopper 170 so that the other end of the emergency lever 130 may be inserted into a space between the hook protrusion 142 and the emergency lever stopper 170. In this regard, the emergency lever 130 may be fixed in the emergency mode as described below.

The second cable 220 may be connected to the other end of the emergency lever 130. More particularly, the second cable 220 may be configured such that tension is applied to the second cable 220 by operating the frunk inside handle 400.

The second cable 220 to which tension is applied may pull the other end of the emergency lever 130 and thus rotate the emergency lever 130. The second cable 220 may be configured to be separated from the first cable 210, and thus not be operated in the basic mode and be operated only in the emergency mode.

The safety hook 140 may be coupled to the front surface of the base 110 so as to be rotatable. More particularly, the safety hook 140 may be configured to move due to operation of the frunk outside lever 500.

A hook plate 141 may be formed at one end of the safety hook 140. A hook protrusion 142, which protrudes from the rear surface of the base 110, may be formed at the other end of the safety hook 140. The hook protrusion 142 may be provided close to the other end of the emergency lever 130 so as to interlock with rotation of the emergency lever 130.

The hook plate 141 may close the guide groove so as to prevent the striker 160 from being released from the guide groove. The safety hook 140 may receive elastic restoring force from a hook return spring. The hook return spring may be mounted on a rotating shaft of the safety hook 140. One end of the hook return spring may be fixed to the safety hook 140 and the other end of the hook return spring may be fixed to the base 110. The hook return spring may provide elastic restoring force so as to return the safety hook 140 to an original position thereof when the safety hook 140 is rotated by the emergency lever 130 and thus opens the guide groove.

The catch 150 may be installed on the rear surface 110 so as to be rotatable. More particularly, the catch 150 may be configured to move in an interlocking manner with rotation of the pawl 120. The catch 150 may serve as a safety device which fixes the striker 160 and thus holds the frunk so as not to be opened during driving.

The catch 150 may be elastically supported by a coil spring. More particularly, one end of the coil spring is fixed to the catch 150 and the other end of the coil spring is fixed to the base 110. Thus, the coil spring may provide restoring force which rotates the catch 150 in the counterclockwise direction if the catch 150 is rotated in the clockwise direction.

The striker 160 may be connected at one end of the striker 160 to the frunk lid which covers the frunk. The other end of the striker 160 may be detachably inserted into the catch 150 and may thus open and close the frunk lid depending on rotation of the catch 150. In the initial state, the striker 160 may be locked with the catch 150.

Figure 4:
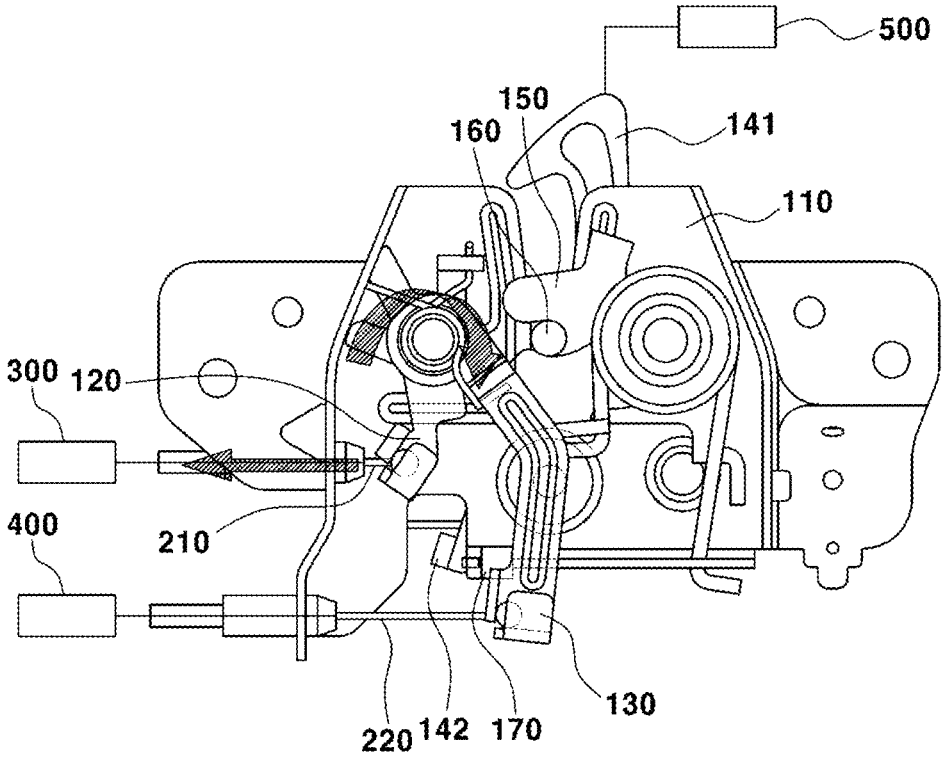
FIG. 4 is a view illustrating a driving state of the frunk latch emergency opening structure according to one embodiment of the present disclosure when tension is applied to a first cable.
Figure 5:
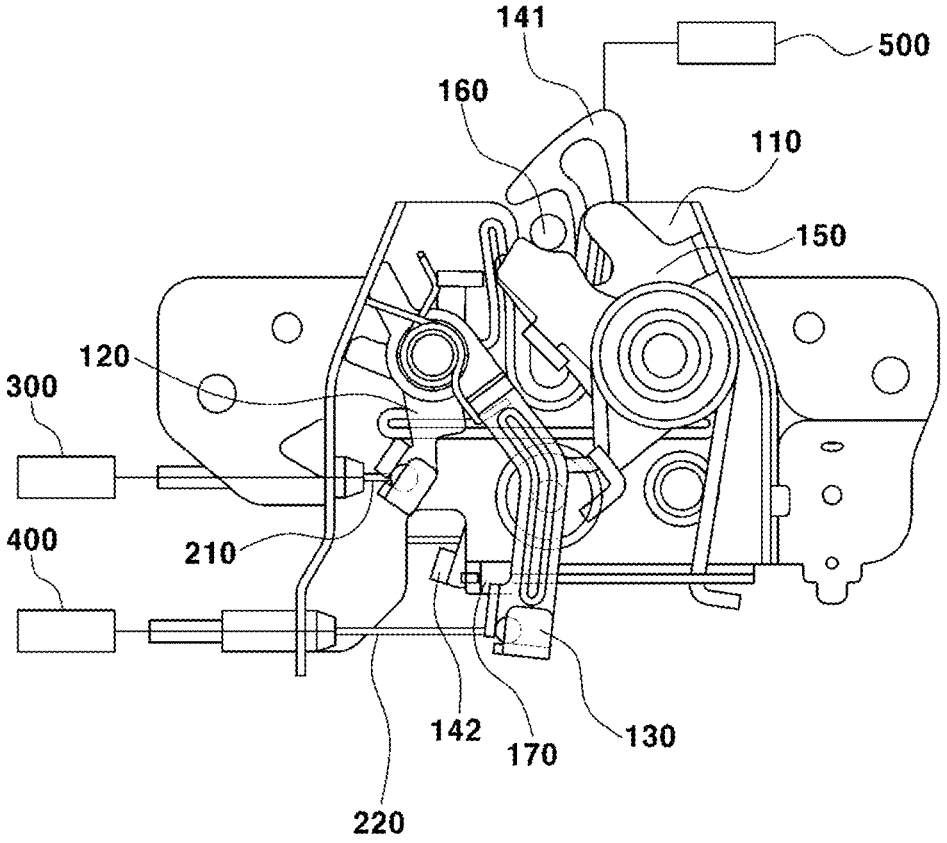
FIG. 5 is a view illustrating an unlocked state of the frunk latch emergency opening structure according to one embodiment of the present disclosure when tension is applied to the first cable.

FIG. 4 is a view illustrating a driving state of the frunk latch emergency opening structure according to one embodiment of the present disclosure when tension is applied to the first cable 210. FIG. 5 is a view illustrating an unlocked state of the frunk latch emergency opening structure according to one embodiment of the present disclosure when tension is applied to the first cable 210.

Referring to FIGS. 4 and 5, the frunk latch emergency opening structure according to one embodiment of the present disclosure may be configured such that, when tension is applied to the first cable 210, one end of the pawl 120 is rotated, the catch 150 is released from the striker 160, and thus, locking of the frunk is released. Further, the safety hook 140 may move due to operation of the frunk outside lever 500, and the frunk may pop up.

In the initial sate in the basic mode, the striker 160 may be locked with the catch 150. When a driver operates the vehicle inside handle 300 disposed at a driver's seat within the vehicle, tension may be applied to the first cable 210. The pawl 120 is pulled and rotated by the first cable 210 to which tension is applied, and thus, binding force applied to the catch 150 may be released.

When the catch 150 is rotated in an interlocking manner with rotation of the other end of the pawl 120, the striker 160 may be released from an insertion groove of the catch 150. Thus, the frunk may be converted from a primary locked state to a primary open state, i.e., locking of the frunk may be released. Consequently, when the frunk outside lever 500 is pushed, the safety hook 140 connected to the frunk outside lever 500 is rotated, binding force which holds the striker 160 is released, and thus, the frunk may be secondarily opened.

As such, the frunk is opened through a two-step operation process in the basic mode. Thus, even if an opening operation occurs because of driver mistake, the frunk is not immediately opened, thereby being capable of preventing safety accidents caused by opening of the frunk during driving.

Figure 6:
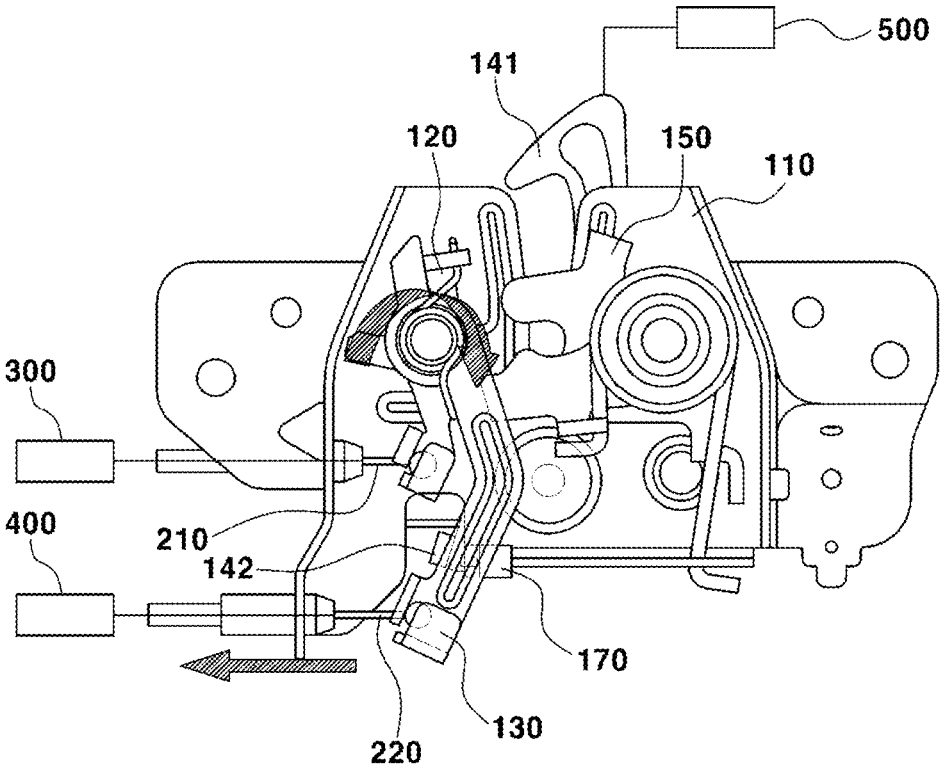
FIG. 6 is a view illustrating a driving state of the frunk latch emergency opening structure according to one embodiment of the present disclosure when tension is applied to a second cable.
Figure 7:
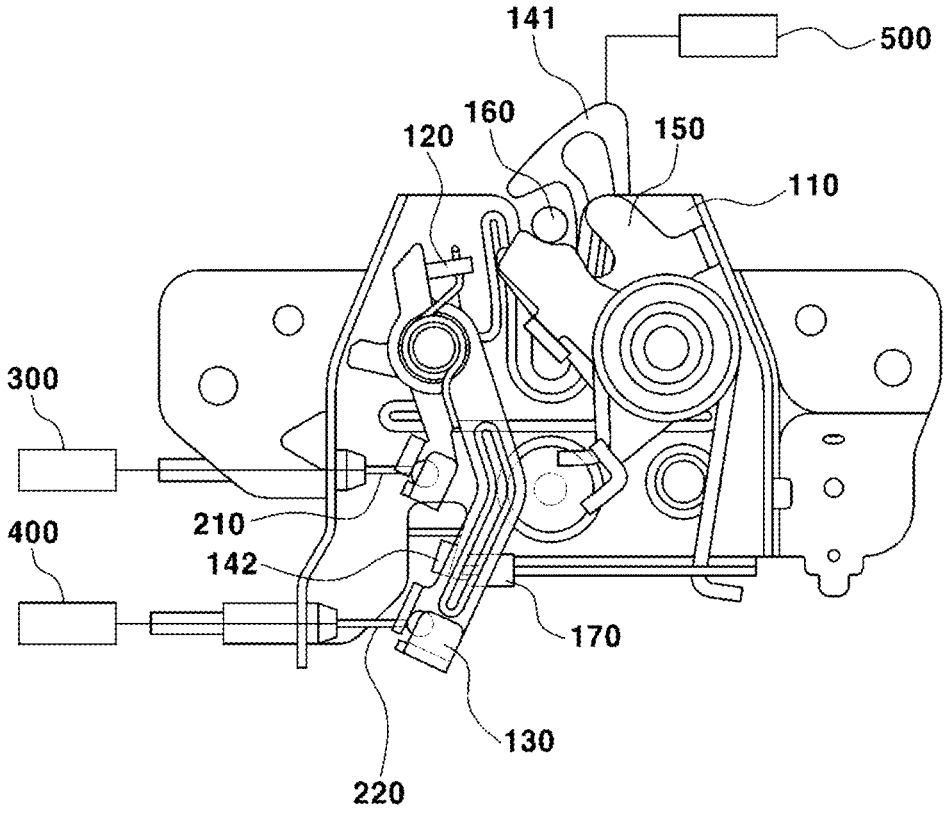
FIG. 7 is a view illustrating an unlocked state of the frunk latch emergency opening structure according to one embodiment of the present disclosure when tension is applied to the second cable.

FIG. 6 is a view illustrating a driving state of the frunk latch emergency opening structure according to one embodiment of the present disclosure when tension is applied to the second cable 220. FIG. 7 is a view illustrating an unlocked state of the frunk latch emergency opening structure according to one embodiment of the present disclosure when tension is applied to the second cable 220.

Referring to FIGS. 6 and 7, the frunk latch emergency opening structure according to one embodiment of the present disclosure may be configured such that, when tension is applied to the second cable 210, the other end of the emergency lever 130 is rotated, the pawl 120 is rotated corresponding to the one end of the emergency lever 130, the catch 150 is released from the striker 160, and thus, locking of the frunk is released.

The frunk inside handle 400 may be formed so as to be connected to the second cable 220 within the frunk. If a person is confined in the frunk, the person may open the frunk by operating the frunk inside handle 400 without the aid of an outsider.

In the emergency mode, first, when the frunk inside handle 400 is pulled, tension is applied to the second cable 220, and thus, the other end of the emergency lever 130 may be rotated. The one end of the emergency lever 130 may interlock with the other end of the pawl 120. More particularly, the one end of the emergency lever 130 may be rotated to push the other end of the pawl 120 and locking of the striker 160 with the catch 150 may be released.

When the catch 150 is rotated in an interlocking manner with rotation of the other end of the pawl 120, the striker may be released from the catch 150. Thus, the frunk may be converted from the primary locked state to the primary open state, i.e., locking of the frunk may be released.

Therefore, the safety hook 140 may be rotated without operation of the separate frunk outside lever 500. More particularly, the other end of the emergency lever 130 may be rotated to push the hook protrusion 142, and the safety hook 140 may be rotated.

In other words, when the safety hook 140 is rotated, binding force which holds the striker 160 is released, and thus, the frunk may be secondarily opened. Therefore, in the emergency mode, primary opening and secondary opening may be continuously performed only by operating the frunk inside handle 400.

Figure 8A:
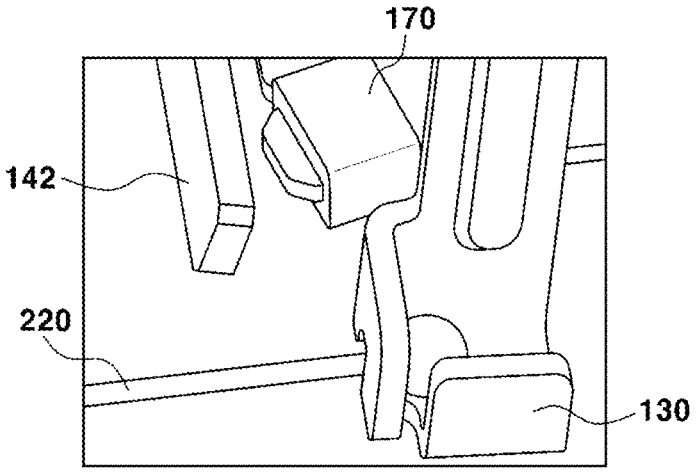
FIGS. 8(*a*) and 8(*b*) are enlarged views of an emergency lever stopper of the frunk latch emergency opening structure according to one embodiment of the present disclosure.
Figure 8B:
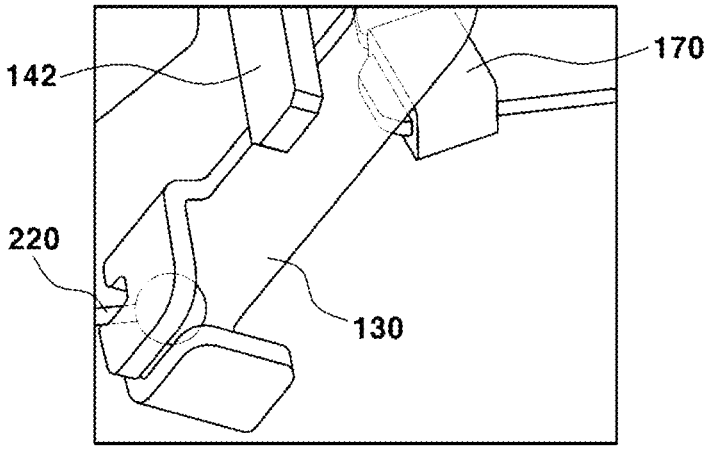
Figure 9:
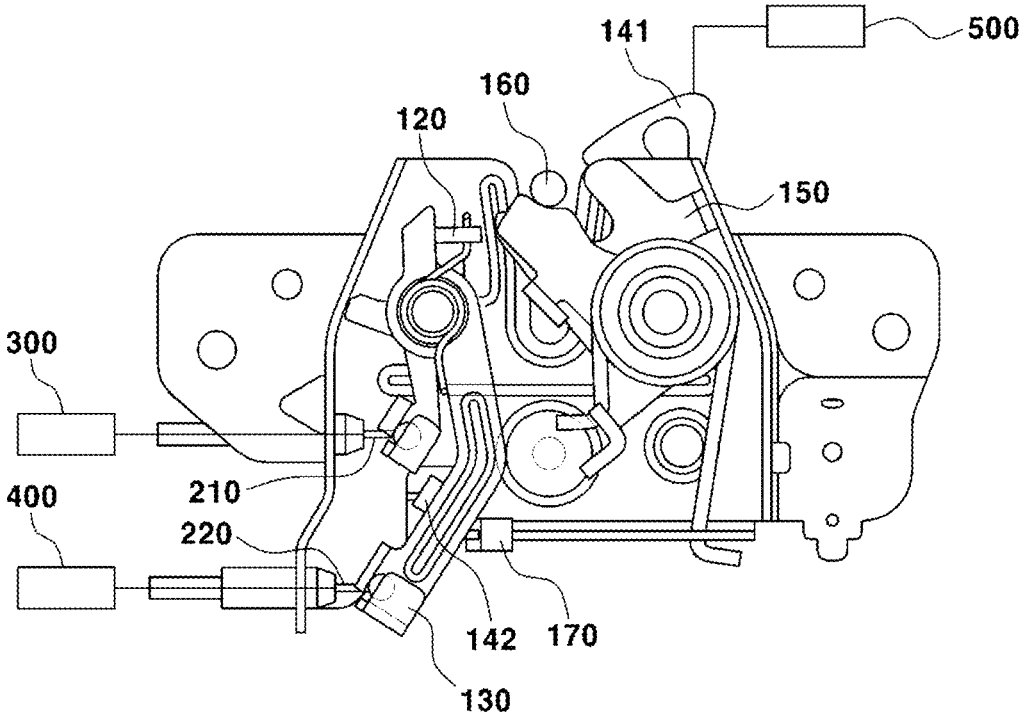
FIG. 9 is a view illustrating an emergency open state of the frunk latch emergency opening structure according to one embodiment of the present disclosure.

FIGS. 8(*a*) and 8(*b*) are enlarged views of the emergency lever stopper 170 of the frunk latch emergency opening structure according to one embodiment of the present disclosure. FIG. 9 is a view illustrating an emergency open state of the frunk latch emergency opening structure according to one embodiment of the present disclosure.

Referring to FIGS. 8(*a*), 8(*b*) and 9, the frunk latch emergency opening structure according to one embodiment of the present disclosure may be configured such that the other end of the emergency lever 130 moves along the side surface of the emergency lever stopper 170 and the hook protrusion 142 moves in an interlocking manner with the other end of the emergency lever 130.

Further, the emergency lever 130 may be inserted into the space between the hook protrusion 142 and the emergency lever stopper 170 and thus be fixed.

In the initial state, the other end of the emergency lever 130 may be located so as to interfere with the rear surface of the emergency lever stopper 170. The hook protrusion 142 may be located close to the front surface of the emergency lever stopper 170. Thereafter, when the frunk inside handle 400 is operated and tension is applied to the second cable 220, the other end of the emergency lever 130 may move along the side surface of the emergency lever stopper 170.

The other end of the emergency lever 130 may be rotated in an interlocking manner with the hook protrusion 142. Thus, the hook plate 141 may be rotated. In other words, differently from the basic mode, in the emergency mode, the safety hook 140 may be rotated without operation of the frunk outside lever 500.

In a state in which a second opening is completed, a sufficient space may be formed between the emergency lever stopper 170 and the hook protrusion 142. Therefore, the emergency lever 130 may be inserted into the space between the hook protrusion 142 and the emergency lever stopper 170 and thus be fixed. More particularly, the other end of the emergency lever 130 may be rotated along the side surface of the emergency lever stopper 170, push the hook protrusion 142, and be caught and fixed to the front surface of the emergency lever stopper 170.

In other words, the other end of the emergency lever 130 may be fixedly inserted into the space between the hook protrusion 142 and the emergency lever stopper 170 so that the safety hook 140 is not returned to the original position thereof by the hook return spring. Therefore, the secondary unlocked state may be maintained and the frunk lid may be opened from the inside of the frunk through rotation of the safety hook 140.

In summary, the present disclosure provides a frunk latch emergency opening structure which is configured not only to be basically operated but also to be opened from the inside of a frunk in case of emergency through a one latch structure.

As is apparent from the above description, the present disclosure may acquire the following effects through the above-described configuration and connection and usage relations.

The present disclosure provides a frunk latch emergency opening structure which is configured not only to be basically operated but also to be opened from the inside of a frunk in case of emergency through a one latch structure, thereby being capable of reducing the size of the latch structure and cutting down the cost of the latch structure.

Further, in the frunk latch emergency opening structure, an electric method as a latch operation method may be replaced with a mechanical method, thereby being capable of increasing the commercial value of the frunk latch emergency opening structure.

The disclosure has been described in detail with reference to embodiments thereof. However, it should be appreciated by those having ordinary skill in the art that changes may be made in these embodiments without departing from the principles and spirit of the disclosure, the scope of which is defined in the appended claims and their equivalents. In other words, while the disclosure has been explained in relation to its embodiments, it is understood that various modifications thereof will become apparent to those having ordinary skill in the art upon reading the specification. These embodiments have been described to explain the best mode to implement the technical scope of the disclosure, and various modifications required in the specific application and purpose of the present disclosure are possible. For example, a frunk outside lever may be integrated with a safety hook. Therefore, the above detailed description of the present disclosure is not intended to limit the disclosure. Further, it must be interpreted that the accompanying claims encompass other modes.

What is claimed is:

1. A frunk latch emergency opening structure comprising:

a base configured to be fixed to a vehicle body;

a pawl provided on the base so as to be rotatable;

a first cable connected to one end of the pawl and configured such that tension is applied to the first cable by operating a vehicle inside handle;

an emergency lever configured to be rotatable in an interlocking manner with the pawl at one end of the emergency lever;

a second cable connected to an other end of the emergency lever and configured such that tension is applied to the second cable by operating a frunk inside handle; and a safety hook configured to be coupled to the base so as to be rotatable and to move due to operation of a frunk outside lever, wherein a hook plate is formed at one end of the safety hook, and a hook protrusion configured to protrude from a rear surface of the base is formed at another end of the safety hook, wherein the one end of the emergency lever interlocks with the pawl, and wherein the other end of the emergency lever is rotated in an interlocking manner with the hook protrusion, further comprising an emergency lever stopper located so as to correspond to the other end of the emergency lever and configured to interfere with the emergency lever during movement of the emergency lever and be fixedly installed such that a side surface of the emergency lever stopper is tilted at a designated angle with respect to the rear surface of the base, wherein the other end of the emergency lever is configured to move along the side surface of the emergency lever stopper when tension is applied to the second cable, such that the other end of the emergency lever translates across the side surface of the emergency lever stopper, wherein the hook protrusion moves in an interlocking manner with the other end of the emergency lever, and wherein the emergency lever is inserted into a space between the hook protrusion and a front surface of the emergency lever stopper, such that the emergency lever is fixed.

2. The frunk latch emergency opening structure of claim 1, further comprising:

a catch configured to move in an interlocking manner with rotation of the pawl; and a striker connected at one end to a frunk lid configured to cover a frunk and provided with another end configured to be detachably inserted into the catch so as to open and close the frunk lid according to rotation of the catch.

3. The frunk latch emergency opening structure of claim 2, wherein:

when tension is applied to the first cable, the one end of the pawl is rotated and the catch is released from the striker, such that locking of the frunk is released.

4. The frunk latch emergency opening structure of claim 3, wherein the safety hook moves due to operation of the frunk outside lever and allows the frunk lid to pop up.

5. The frunk latch emergency opening structure of claim 2, wherein:

when tension is applied to the second cable, the other end of the emergency lever is rotated; and the pawl is rotated corresponding to the one end of the emergency lever and the catch is released from the striker, such that locking of the frunk is released.

* * * * *